US006033187A

United States Patent [19]

Addie

[11] Patent Number: 6,033,187

[45] Date of Patent: Mar. 7, 2000

[54] METHOD FOR CONTROLLING SLURRY PUMP PERFORMANCE TO INCREASE SYSTEM OPERATIONAL STABILITY

[75] Inventor: Graeme R. Addie, Martinez, Ga.

[73] Assignee: GIW Industries, Inc., Grovetown, Ga.

[21] Appl. No.: 08/953,135

[22] Filed: Oct. 17, 1997

[51] Int. Cl.[7] ..... F04B 49/00; F04D 29/44

[52] U.S. Cl. ..... 417/18

[58] Field of Search ..... 417/22, 18, 19, 417/31, 53, 63, 44.2, 44.3

[56] References Cited

U.S. PATENT DOCUMENTS

| | | | |
|---|---|---|---|
| 4,029,362 | 6/1977 | Kortenbusch | 406/18 |
| 4,211,518 | 7/1980 | Kortenbusch | 417/54 |
| 4,366,121 | 12/1982 | Krijgsman | 422/110 |
| 4,442,665 | 4/1984 | Fick et al. | 60/39.12 |
| 4,484,861 | 11/1984 | Sweeney et al. | 417/15 |
| 4,547,132 | 10/1985 | Uchida et al. | 417/63 |
| 5,772,403 | 6/1998 | Allison et al. | 417/44.2 |
| 5,813,833 | 9/1998 | Addie et al. | 415/206 |

*Primary Examiner*—Charles G. Freay
*Assistant Examiner*—Robert Z. Evora
*Attorney, Agent, or Firm*—Thomas, Kayden, Hostemeyer & Risley

[57] ABSTRACT

This invention provides a method for controlling slurry pump performance to better operate the pump and increase system operating stability. Such control is achieved by determining the instantaneous pressure produced by the pump (and the internal specific gravity that goes along with that) and using this pressure value along with the overall total pipeline resistance to determine the optimal instantaneous operating speed of the pump. When the pump is controlled in this manner, the adverse cavitation, wear, and other effects on the pump and pipeline associated with unstable system operation can be reduced or avoided.

12 Claims, 7 Drawing Sheets

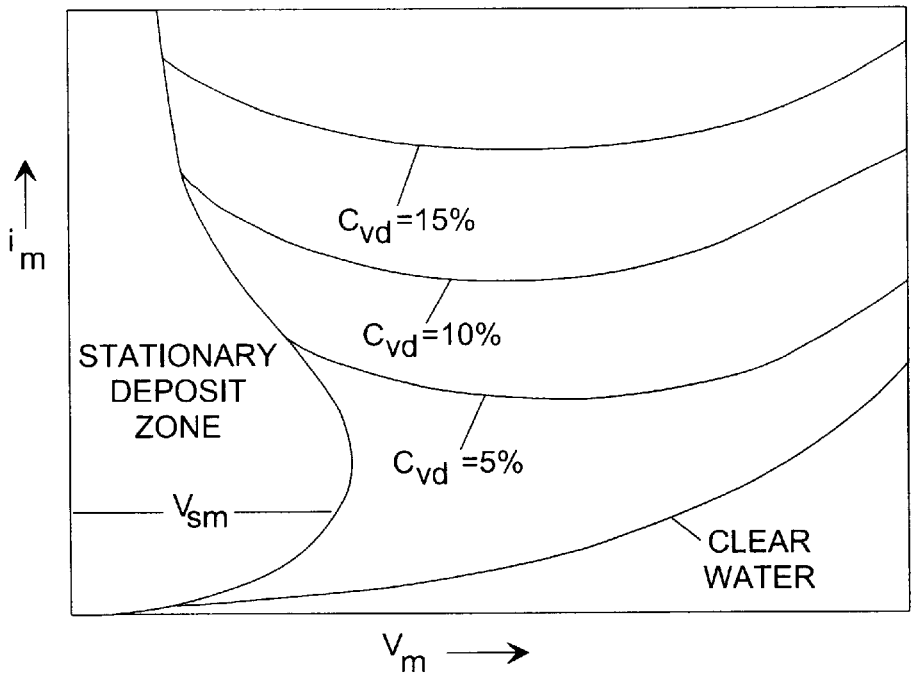
FIG. 1 *(PRIOR ART)*
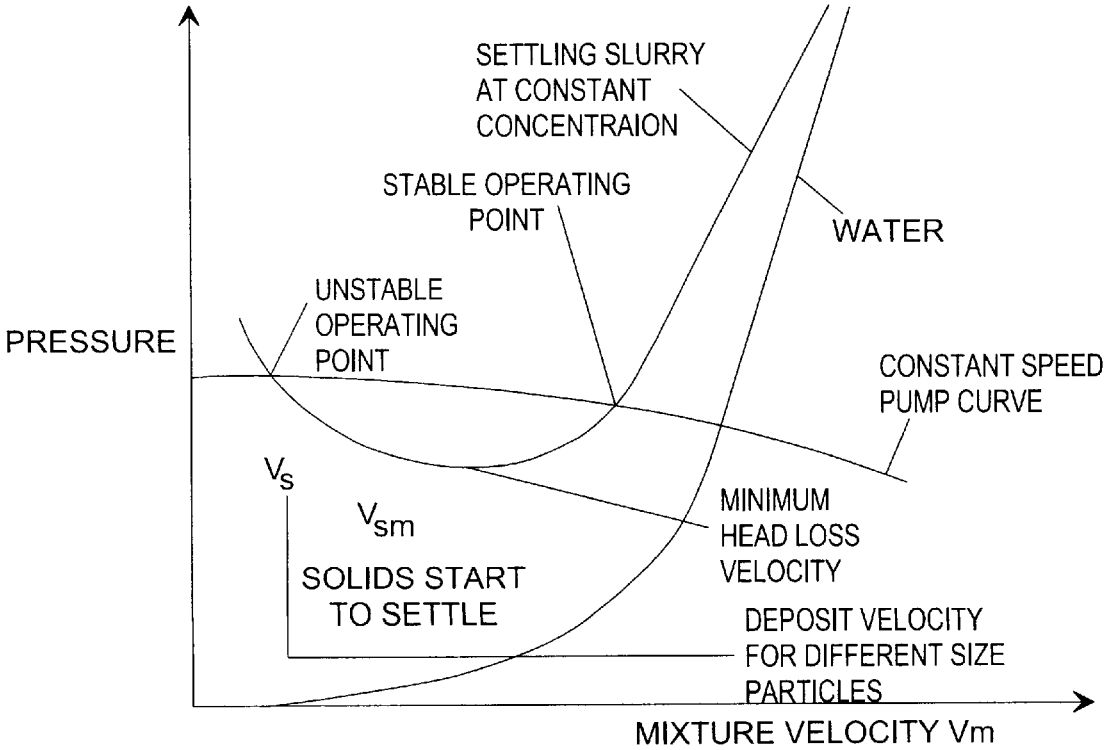
FIG. 2 *(PRIOR ART)*

*FIG. 5* *(PRIOR ART)*

EFFECT OF SLURRY ON PUMP CHARACTERISTICS (SCHEMATIC).

METHOD FOR CONTROLLING SLURRY PUMP PERFORMANCE TO INCREASE SYSTEM OPERATIONAL STABILITY

BACKGROUND OF THE INVENTION

A common method of transporting solids used in the mining, dredging, and other industries is to pump these materials as a mixture of water and solids inside a pipeline using slurry pumps. Centrifugal slurry pumps are similar to centrifugal water pumps except that they are modified to better suit and resist the abrasive nature of the slurries they have to pump. These modifications are many, but primarily relate to a more robust construction to accommodate higher horsepower, fewer vanes to allow the passage of large solids, and the construction of the wet end of the pump in thicker, hard metal (or rubber) wear resisting materials.

The slurries that these pumps transport generally consist of mixtures of water and various solids of different sizes at different concentrations. Examples of slurries are phosphate matrix, copper ore, taconite ore, and crushed rock and sand as is encountered in dredging. For pipeline transport of a normal crushed rock or other conventional settling slurries to occur as a mixture of water and solids, a certain minimum mean mixture velocity called the deposit velocity, $V_{sm}$, must be exceeded. The deposit velocity varies with the pipe size, particle size, solids specific gravity, and particle shape and concentration. A typical slurry is composed of a variety of sizes and shapes of particles, so the deposit velocity, in practice, is also not one number but a range of velocities over which a bed forms. The head loss characteristic for most settling slurries at different delivered concentrations is normally taken to be a U-shape as shown in FIG. 1 with a minimum head loss value that increases at higher and lower velocities. For operation with constant speed centrifugal pumps, operation is usually recommended at a velocity at least slightly higher than the larger of the minimum head loss velocity or the deposit velocity shown at constant concentration in FIG. 2, in order to avoid operation where it could be unstable or where bed formation occurs.

Calculated Head Loss in Horizontal Conveying

The head loss or pipeline friction along a pipe conveying a settling slurry is conventionally expressed as head in meters (or feet) of carrier liquid per meter (or foot) of pipe, $i_m$. The corresponding head loss for the carrier liquid alone at the same mixture velocity will be denoted by $i_w$. The excess head loss resulting from the presence of the solids is then $(i_m - i_w)$. Empirical correlations usually attempt to predict either $(i_m - i_w)$ or the relative increase in head loss, $(i_m - i_w)/i_w$. Some of these correlations and their applications to slurries containing a wide range of particle sizes are explained by *Wasp* (Wasp, E. J. et al. [2], 1977, Solids-liquid flow-slurry pipeline transportation, *Trans. Tech Publications.*). However, in the applicant's experience it is much more reliable to base design on tests carried out on slurry representative of that to be pumped in practice.

A method of scaling up test results consists of distinguishing between different modes of solids transport and assessing the contributions of the different modes to $(i_m - i_w)$. This approach can be derived from *Wilson's* development (Wilson, K. C., [3], 1992, Slurry Transport Using Centrifugal Pumps. Elsevier Applied Science, London and New York.) of early work on settling slurries by Newitt and *Clift* (Clift, R., et. Al. [4], 1982, A mechanistically-based method for scaling pipeline tests for settling slurries, Proc. Hydrotransport 8, BHRA Fluid Engineering, Cranfield, UK, pp. 91–101.). Tests have shown that for a large number of heterogeneous slurries without excess fines and in the heterogeneous region of interest, the above may be simplified to $$i_m = i_f + (S_m - 1)\left(\frac{U_u}{V_m}\right)^{1.7} \qquad \text{Equation 1}$$

as outlined by Carstens and *Addie* (Addie, G. R., 1982, Slurry pipeline friction using nomographs. Froc. District 2 Meeting, (Sept lles, Quebec), Canadian Inst. Mining and Metallurgy.). Where the $U_u$ constant is shown in FIG. 3 from *Addie* plotted for different D50 mean size slurries, and the form of equation 1 is the expected inverted parabola shown in FIG. 1. The minimum head loss $V_{sm}$ value in FIG. 1, calculated using the above for clean (no fines) crushed rock slurries for different constant (operating) concentrations in different diameter pipe sizes, is shown in Table 1.

TABLE 1

Minimum Head Loss (Stable) Velocity (ft/sec) (Horizontal Pipe, Solid's SG 2.65, Particle Shape Factor 0.26) for Clean (No Fines) Crushed Rock Slurry

| Pipe Size | Concentration | Particle Size (D50) Micron | | | |
|---|---|---|---|---|---|
| Inch | % by Vol. | 100 | 500 | 1000 | 5000 |
| 4 | 10 | 4.0 | 8.2 | 9.3 | 11.4 |
| | 20 | 4.9 | 10.0 | 11.3 | 13.8 |
| | 30 | 5.5 | 11.2 | 12.6 | 15.5 |
| 8 | 10 | 5.1 | 10.3 | 11.7 | 14.4 |
| | 20 | 6.2 | 12.5 | 14.2 | 17.4 |
| | 30 | 6.9 | 14.0 | 15.9 | 19.4 |
| 15¼ | 10 | 6.3 | 12.8 | 14.5 | 17.7 |
| | 20 | 7.6 | 15.5 | 17.5 | 21.4 |
| | 30 | 8.6 | 17.3 | 19.6 | 23.9 |
| 17¼ | 10 | 6.6 | 13.3 | 15.1 | 18.4 |
| | 20 | 8.0 | 16.1 | 18.2 | 22.3 |
| | 30 | 8.9 | 18.0 | 20.4 | 24.9 |
| 19¼ | 10 | 6.8 | 13.8 | 15.6 | 19.1 |
| | 20 | 8.2 | 16.7 | 18.9 | 23.1 |
| | 30 | 9.2 | 18.7 | 21.1 | 25.8 |
| 24 | 10 | 7.3 | 14.8 | 16.8 | 20.5 |
| | 20 | 8.9 | 17.9 | 20.3 | 24.8 |
| | 30 | 9.9 | 20.0 | 22.7 | 27.7 |
| 30 | 10 | 7.9 | 15.9 | 18.0 | 22.0 |
| | 20 | 9.5 | 19.2 | 21.3 | 26.6 |
| | 30 | 10.7 | 21.5 | 24.3 | 29.7 |

While the above holds true for most of slurries in the range of sizes noted, it does not apply to very large particles and coal where the particle shape (and solids specific gravity) is different from that of conventional crushed rock.

Other methods of calculating the head loss characteristics of heterogeneous slurries exist. These give roughly comparable values or, at least, produce the same characteristics. Regardless, most settling slurries have a horizontal pipe head loss characteristic of a U shape with a minimum head loss which can be called the minimum stable operating velocity.

Centrifugal Slurry Pump Performance

If a given pump is driven at a constant shaft speed (i.e., fixed N), a series of readings of Q, H, and P can be obtained at various openings of the throttling value located downstream of the pump. The head can be plotted directly against discharge, as shown on FIG. 4. This curve is known as the head-discharge characteristic, or the head-quantity (or head-capacity) relation, or simply the H-Q curve. The required power and the efficiency are also plotted against Q, as shown in FIG. 4, which illustrates representative pump characteristic curves.

With N constant, the efficiency, $\eta$, varies only with the ratio HQ/T, where T is always greater than zero. Thus, $\eta$ will be zero at the no-flow condition (Q=0) and again when the H-Q curve intercepts the discharge axis (here H=0). Between these extremes, the efficiency curve displays a maximum, as shown on the figure. This maximum defines the 'best efficiency point' ("BEP"), and the associated discharge and head are often identified as $Q_{BEP}$ and $H_{BEP}$.

The curves shown in FIG. 4 refer to a single angular velocity. Therefore, if the tests were repeated with a different value of N, all the points shift. This behavior can be plotted as a series of H-Q curves for various angular speeds, with contours of efficiency and power added as shown in FIG. 5, which is a pump performance chart. Test data are not required for each curve; instead, the various constant-speed curves are constructed on the basis of the following simple scaling relations. All discharges (including both $Q_{BEP}$ and the discharge at H=0) shift in direct proportion to N, while all heads (including both the non-flow head and $H_{BEP}$) shift in proportion to $N^2$.

The power output of the pump is determined by the product of Q and H, and is given by $$(\text{Power})_{out}=PfgQH=P\cdot fg\cdot Q\cdot H \qquad \text{Equation 2}$$

where Pf is the fluid density. This relation applies in any consistent system of units. Thus, SI units give the power out in watts, which is usually divided by 1000 to obtain kilowatts. In the units in common use in the United States, Q is expressed in U.S. gallons per minute, and H in feet. Output power of a pump is expressed as water horsepower, and a numerical coefficient is required in the equation.

With the pump overall efficiency $\eta_p$ included, and the head H expressed in units of liquid (as mixture) produced (feet), then the pump input power, p, is $$P=\frac{Q\cdot H\cdot SG}{3960\cdot \eta p} \qquad \text{Equation 3}$$

where specific gravity is the mixture specific gravity.

Effect of Solids on Performance

The presence of solid particles in the flow tends to produce adverse effects on pump performance. The effects on pump characteristics are shown schematically in FIG. 6, which is a definition sketch for illustrating the reduction in head and efficiency of a centrifugal pump operating at constant rotary speed and handling a solid-water mixture. In this sketch, $\eta_m$ represents the pump efficiency in slurry service and $\eta_w$ is the clear-water equivalent. Likewise, $P_m$ and $P_w$ are the power requirements for slurry service and water service, respectively. The head $H_m$ is developed in slurry service measured in height of slurry, while $H_w$ represents the head developed in water service, in height of water. The head ratio $H_r$ and efficiency ratio $\eta_r$ are defined as $H_m/H_w$ and $\eta_m/\eta_w$, respectively. The fractional reduction in head (the head reduction factor) is denoted by $R_H$ and defined as $1-H_r$. For efficiency, the fractional reduction (efficiency reduction factor) is $R\eta$, given by $1-\eta_r$. Values of $R_H$ and $\eta_r$ vary from zero to 10% for most heterogeneous slurries, but can be higher as solids size and concentration get higher. Reasonably accurate values for $R_H$ and $\eta_r$ may be predicted from charts in *Wasp* and *Wilson*.

Stability Considerations

FIG. 7 shows typical system characteristics for a settling slurry at three delivered concentrations, in two forms. In FIG. 7(*a*), the friction gradient is expressed as head of carrier liquid, $i_m$, while FIG. 7(*b*) gives the same information in terms of head of slurry, $j_m$. For simplicity, only the frictional contribution is considered here, i.e., the discussion refers to horizontal transport.

The total developed head, measured in terms of delivered slurry density (FIG. 7(*b*)), decreases slightly with increasing concentration due to the effect of solids on pump performance discussed in Wasp and Wilson. Therefore, the pump discharge head, measured as the water column equivalent to the discharge pressure of the pump, increases with slurry concentration. This increase is in slightly less than direct proportion to $S_{md}$. For the case illustrated by FIG. 7, where the pump has been selected for operation close to the standard velocity at point A, the system can accommodate variations in solids concentration from zero up to the maximum shown. Accordingly, there will be some reduction in mean velocity as $C_{vd}$ increases, because of the effect of the solids on the pump characteristic (FIG. 7(*a*)), but the variation in steady-state operating conditions is slight.

Transient behavior can be more interesting than steady-state operating conditions. Consider the case where the system has been operating steadily at a unit concentration of 2, and the slurry presented to the pump suddenly changes to a higher unit concentration of 3. Referring to FIG. 7(*a*), the system characteristic is now as 2, but the pump is handling a higher-density material so that its discharge pressure increases to characteristic 3. Thus, the immediate effect is to shift the system operating conditions to point B, increasing both the mean slurry velocity and the power drawn by the pump. As the higher solids concentration propagates along the line, the system resistance moves up to characteristic 3, so that the velocity decreases and system operation moves back to point C. Conversely, if the system has been operating steadily at point A and the slurry entering the pump is suddenly reduced to a unit concentration of 1, the mixture velocity is reduced as the system moves to point D. As before, the system resistance now moves gradually back to characteristic 1, and operation moves back to point E.

FIG. 8 illustrates operation of the same system but with pumps selected to operate further back on the system characteristics, giving a velocity below the standard value at a unit concentration of 2. The result of increasing solids concentration to characteristic 3 is now to be considered. As before, the effect on the pump occurs before the new concentration has propagated along the pipeline, so that the immediate effect is to shift operation from A' to B'. The system again responds more slowly, and the pipe velocity therefore decreases from the maximum at B'. However, in this case, steady operation at concentration 3 is not possible with fixed-speed pumps because they cannot generate sufficient head. Thus, when the system reaches a characteristic corresponding to 3*a*, the velocity abruptly reduces back into the deposit region. In other words, the line becomes plugged. FIG. 8(*a*) shows that reducing the solids concentration, even to the point of pumping water alone, cannot clear the plug; higher pump speeds are needed, or, alternatively, a slurry of fine particles can be used to attempt to shift the deposit. If variable-speed pump or clay slurry is not available, however, the only recourse will be to open up the line at some intermediate point and pump the solids out.

Two general conclusions can be drawn from the foregoing discussion. First, comparing the system and pump characteristics is essential, because it enables qualitative but very informative assessment of operating stability. For systems driven by centrifugal pumps, operation at velocities below the standard velocity is feasible only for relatively fine slurries (see below) or for systems where the solids concentration is not subject to wide variations. FIG. 8 also illustrates why the velocity at the limit of deposition is often unimportant for settling slurries; although operation led to a plugged line, the cause was poor matching (or control) of the pump and system characteristics, rather than operation too close to deposition. This also illustrates why field data often indicates deposit velocities much above the calculated values; they actually correspond to the limit of stable operation with centrifugal pumps, rather than the limit of operation without a stationary deposit. In practice, centrifugal pumps permit operation near the deposition point only for relatively fine particles. Where the pipeline head includes a large static component such as in mill cyclone feed and other circuits, then the system characteristic is flatter and the above behavior may be more pronounced.

Operation of Prior Art in the Field

Unstable operation as described above often results in plugging of a line or, in the case of a system where the suction sump level is significant in relation to the total head, may result in large swings in flow through the pump as the pump stops pumping and then restarts as the sump level increases and lowers the system characteristic back down below that of the pump. This is true in the case of cyclone feed service. Often, the dictates of the mull and the grinding process force operation at a flow that is unstable. Here, the pump often is forced to run with the sump emptying and filling with the flow surging wildly back and forth. Although it is possible that the average flow will satisfy the mill needs, the result on the pump is excessive wear and tear due to the large variation of percent of BEP quantity flow operation.

As noted earlier, the operating point must always be where the pressure produced by the pump is equal to that of the system, the resistance of the system being a function of the specific gravity of the mixture, the elevation (or static head) change, the friction in the pipeline, and any cyclone pressure. These system values can usually be measured or calculated using magnetic, venturi, or Doppler flowmeters; with nuclear 'U' loop or other density meters and a variety of different pressure gauges noting that, where the static head is large in relation to the friction, a flow and specific gravity measurement with calculated pipeline friction and elevation (from measured level differences) head may be used.

It should be noted that the slurry is incompressible for all practical purposes and the flow is the same in the pump and the pipeline. The density size of solids, etc., on the other hand, can vary along the pipeline. If, however, we average readings over the average time it takes for the slurry to go through the system (normally in cyclone feed service about 10 seconds), then we can establish a good overall average of the pipeline resistance at a given time.

The balancing pressure (or unbalancing as the case may be) produced by the pump is directly related to the pump, its speed, the flow, and the density or specific gravity of fluid inside the pump at a particular time. The performance of the pump on clear water at a given speed and flow is usually known in terms of its tested water performance for the head produced and power consumed. The pump-input power is normally available either as electrical motor driver watts or amps, a measured torque, or even pressures and/or rack position for a diesel engine driver. Regardless of how it is collected, the pump-input power can be calculated using one or more of the above methods using the readings noted and as necessary known or determinable motor, gearbox or other efficiencies. Here, it should be noted that, in almost all cases, the power reading can be obtained over a short period of time (or instantaneously) as necessary.

Using the pump input power and the known pump characteristics along with known, calculated, or measured solid effect corrections for the slurry effect or the performance in relation to its water performance, an instantaneous pressure produced by the pump and specific gravity within the pump can be determined.

SUMMARY OF THE INVENTION

This invention provides a way of determining the instantaneous pressure produced by the pump (and the internal specific gravity that goes along with that) and how the instantaneous pressure can be used in relation to the overall total pipeline resistance to control and/or adjust the pump performance to better operate the pump and/or reduce or eliminate the unsuitable unstable operation described earlier, as well as all of the adverse cavitation, wear, and other effects on the pump and pipeline that go along with that.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

FIGS. 1–8 are performance charges of prior art pumps.

DETAILED DESCRIPTION

Figure 3:
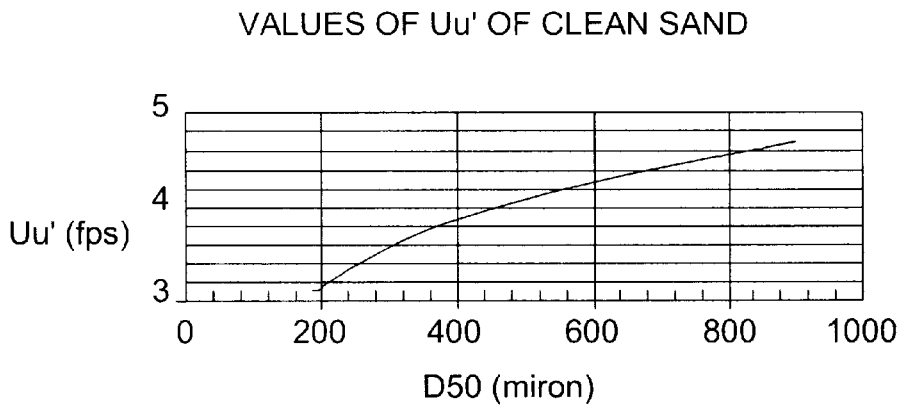
FIG. 3 (PRIOR ART)
Figure 4:
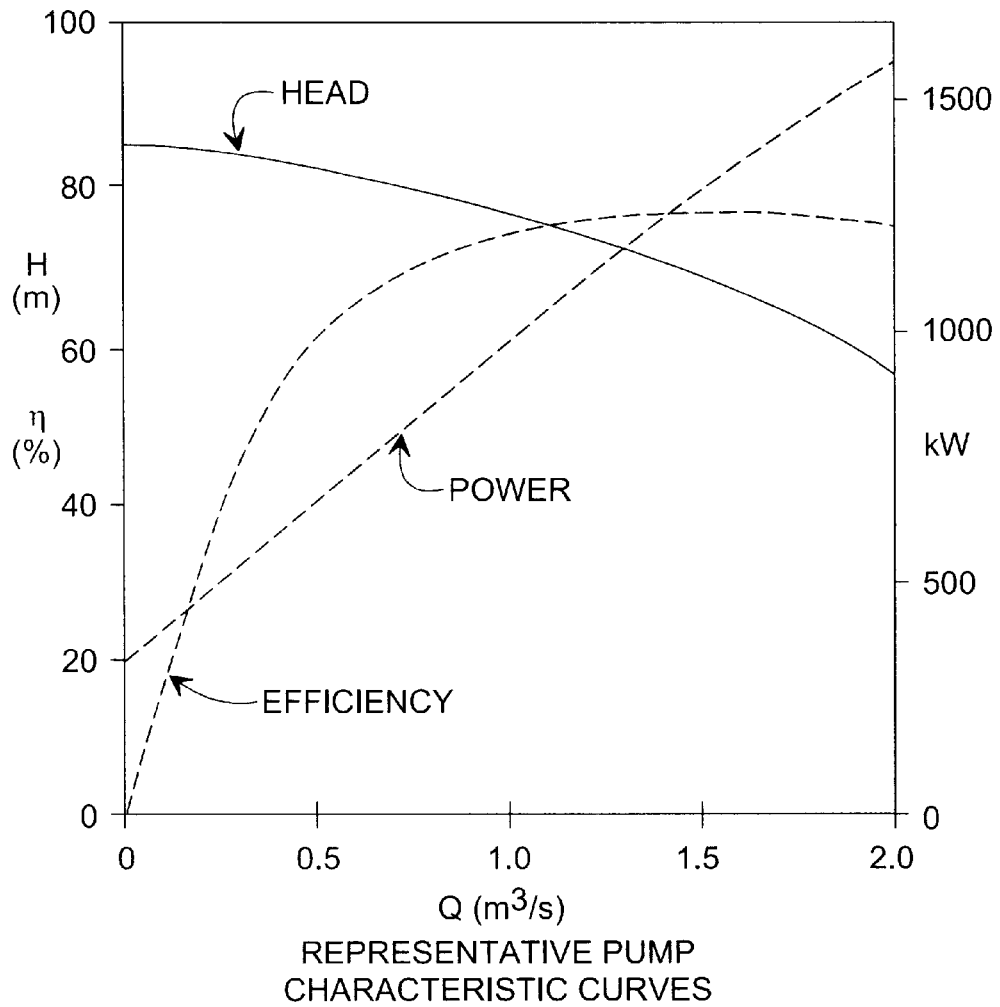
FIG. 4 (PRIOR ART)
Figure 5:
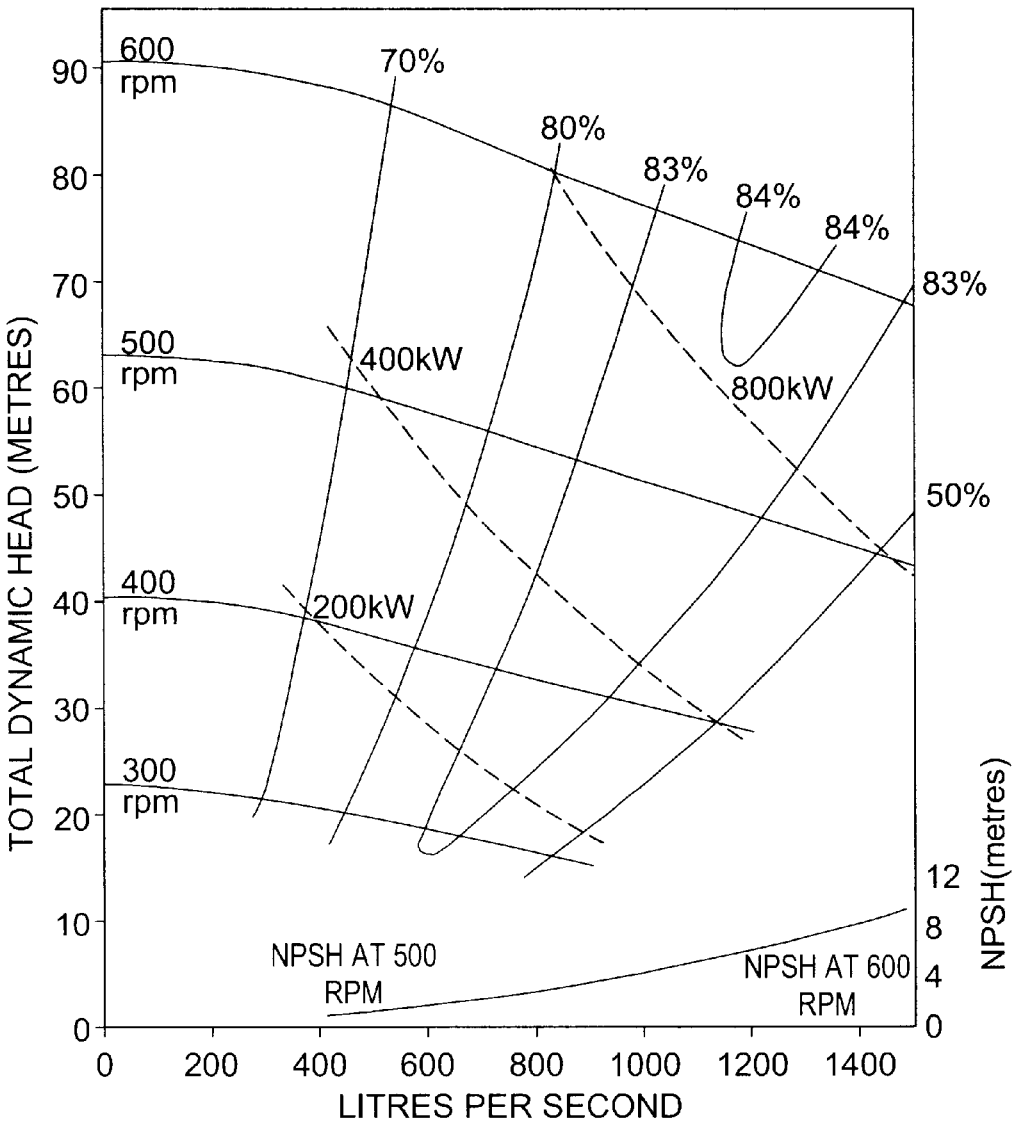
Figure 6:
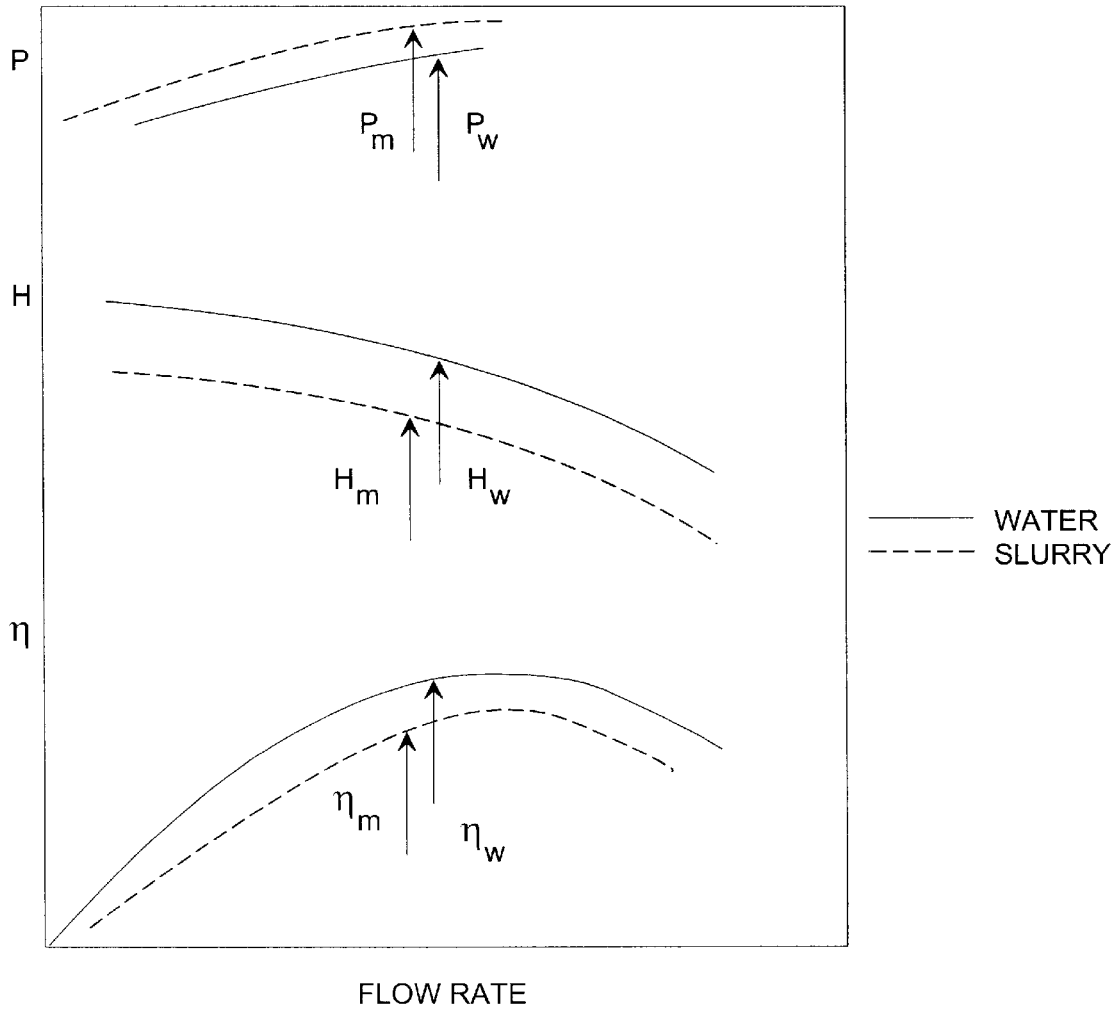
(PRIOR ART) FIG. 6
Figure 7A:
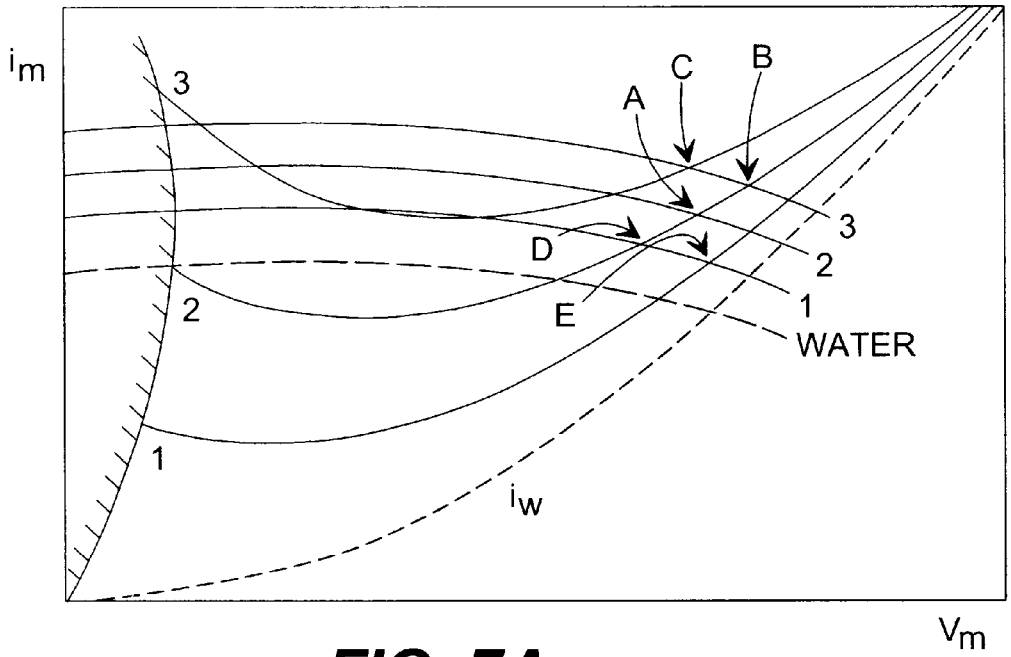
FIG. 7A (PRIOR ART)
Figure 7B:
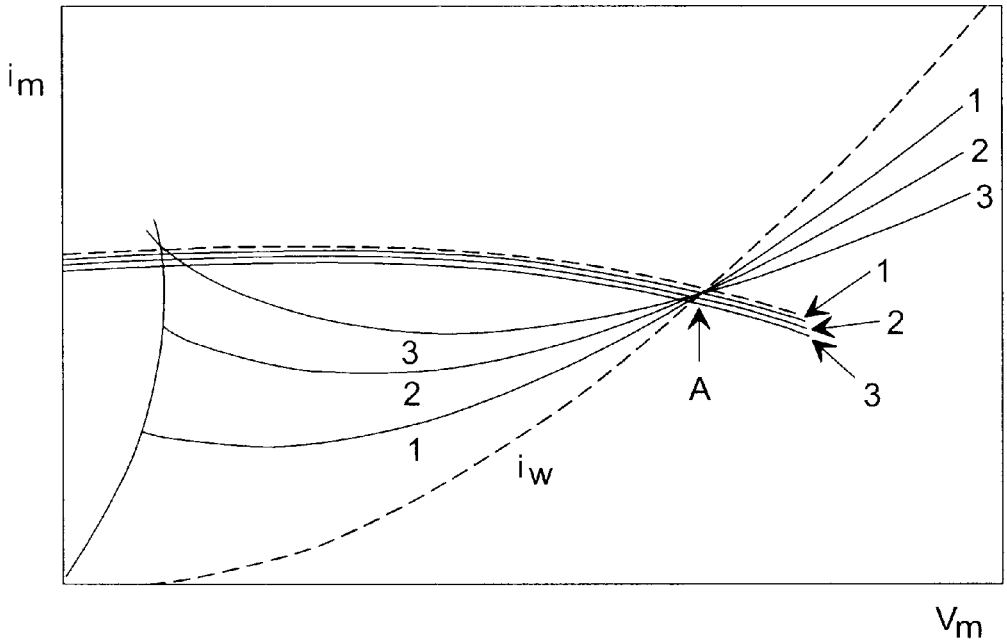
FIG. 7B (PRIOR ART)
Figure 8A:
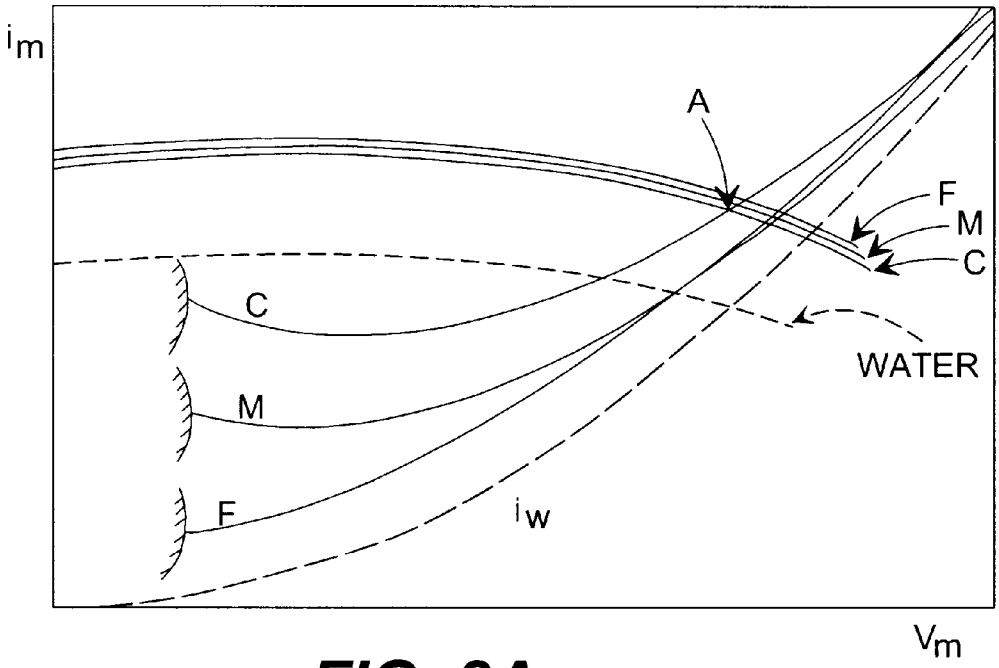
FIG. 8A (PRIOR ART)
Figure 8B:
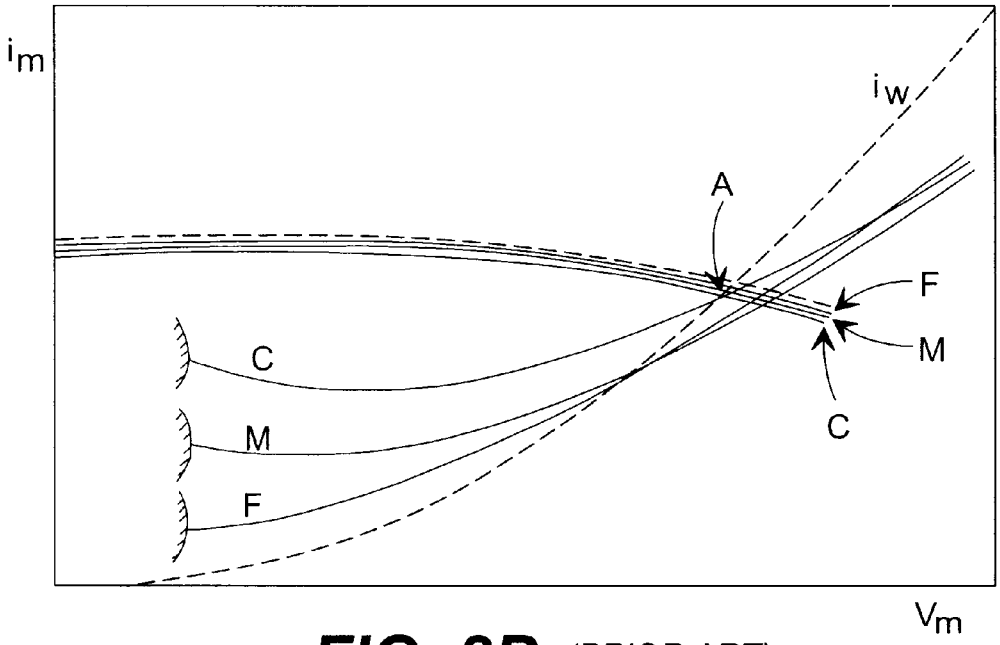
FIG. 8B (PRIOR ART)

Specifically this invention is about using the measured pump input power, the known or measured speed, and the previously known performance of the pump (either on slurry or with solids effect corrections relative to water) to determine the instantaneous pump driving pressure (and specific gravity) and of using this to better control the pump so that it operates in equilibrium with the system and in a stable manner. The system pressure used for comparison here would be one determined normally on a continuous average basis. This could be the calculated sum of the system static head, cyclone pressure, and pipe friction using conventional flow and specific gravity meter measurements or could even be from a system pressure sensor. Stable operation would, in principal, aim to keep the instantaneous pump pressure in equilibrium with the continuous average system pressure, while at the same time, satisfying input flow and sump level constraints.

As noted before, the following relation can be used to determine the instantaneous pump pressure and specific gravity $$P = \frac{Q \cdot H_m \cdot SG}{3960 \cdot \eta p} \qquad \text{Equation 3}$$

where

P=pump input power in horsepower

Q=USgpm units of flow $H_m$=pump head in ft of slurry mixture

SG=specific gravity of the mixture inside the pump

ηp=pump efficiency

The term ηp depends mainly on the pump quantity Q at a given rotating speed N, but also should be corrected or adjusted for the effect of solids size, specific gravity, etc. The ηp and H value depends partially on the specific gravity which is known initially only in the combined term H×SG. Initial values of ηp and H used, however, can be found from the previously established water performance test values for the pump at the measured flow and rpm to determine an initial specific gravity. Then, final values of ηp and H can be determined by using a solids effect correction, and resubstitution of the specific gravity value until the difference in the specific gravity used in the correction is close to the value determined in the combined term.

In the first case, knowing the pump instantaneous input power, the rpm, and the system flow and system specific gravity, the first case pump efficiency without solids effect can be determined by using the pump tested or estimated water performance. At this stage, the term $H_m \times SG$ represents an approximate value of the instantaneous pump pressure in units of pressure, usually of feet of $H_2O$.

The known pump size, the approximate slurry size, and the average system slurry specific gravity then can be used to determine a solids effect value for $H_R$ and $\eta_p$ in the equations from Wilson as follows $$HR=H_m/H_w \text{ and } \eta p=\eta_m/\eta_w \qquad \text{Equation 4}$$

and again using the tested or estimated water performance curve, a more precise instantaneous value of slurry specific gravity may be calculated using equation 3.

If the values of HR and ηp are adjusted to reflect the new instantaneous specific gravity, and the above repeated until the changes in specific gravity are small, then a close estimate of the instantaneous pump pressure and internal concentration (specific gravity) can be determined for use in the control of the pump.

In the above, the value for P is usually determined by the instantaneous reading of the driver input power. In the case of an electric driver, this could be from a wattmeter and a correction for the motor efficiency, or it could be using the instantaneous amps, using the commonly known relation $$P = \frac{\sqrt{3}\, EI\cos\phi\eta_m}{.746} \qquad \text{Equation 5}$$

where

E=volts

I=amps cosΦ=motor power factor usually 0.8 for a 3 phase motor and $\eta_m$=motor and/or gearbox efficiency The instantaneous specific gravity is the unknown or determined value here which, in turn, depending on the slurry, can be used with a correction (as described) to determine the pump pressure produced in feet of units of $H_2O$.

$$\text{Pressure}_{(pump)}=SG\cdot H_m \qquad \text{Equation 6}$$

Therefore, in a control system, the instantaneous pump pressure can be used to compare with the resisting pressure of the system, usually determined using the measured overall elevation differences, a specific gravity measurement taken over the approximate time the slurry takes to go through the system, and a calculated value for the pipe friction component using $$H_{system(ft\ H20)}=\text{elevation diff.}\times SG+\text{Pipe Friction+any cyclone pressure} \qquad \text{Equation 7}$$

The difference between the value of Gap $\text{Pressure}_{(pump)}$ above and the $H_{system}$ value (and alternatively the pump and system specific gravity values) represents the instantaneous destabilizing driving pressure. This difference can then be used in a control circuit with appropriate timing and averaging, or other method to correct the imbalance by the common methods known. Here, adjusting the speed of the pump using the commonly known affinity laws of $$H_2 = \left(\frac{N_2}{N_1}\right)^2 H_1 \qquad \text{Equation 8}$$

where

H=pump head

N=pump speed

1=initial

Figure 9:
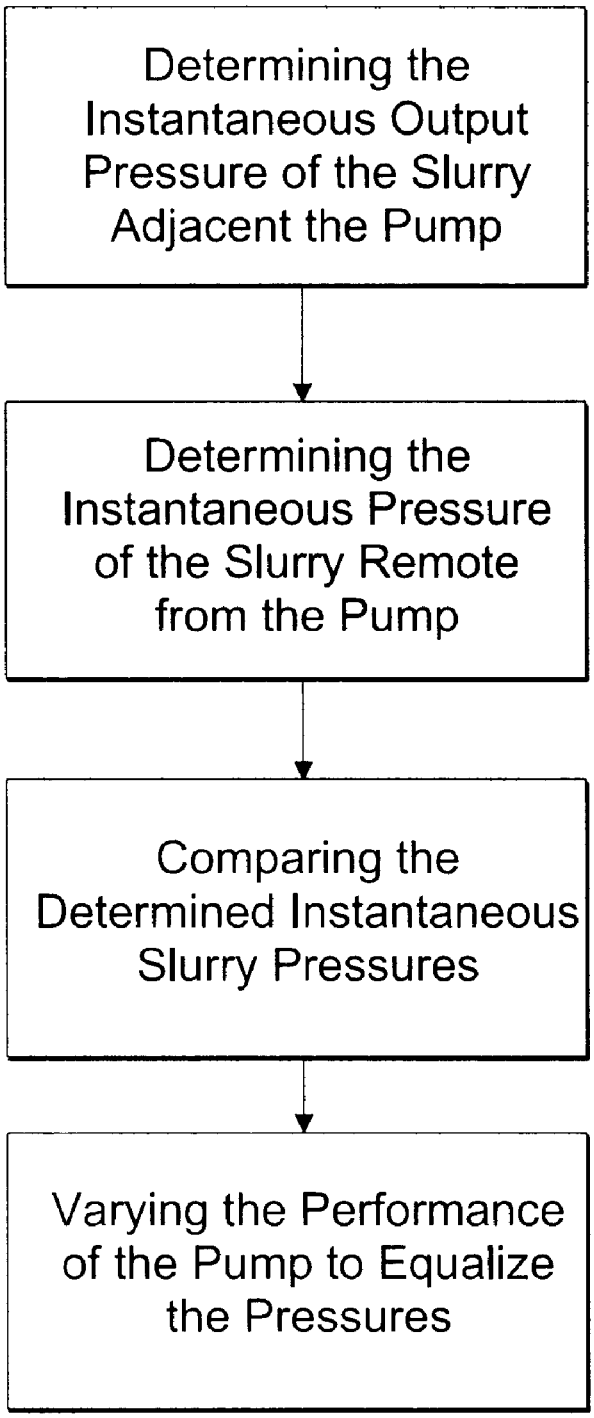
FIG. 9 is a schematic of a method for controlling the operation of a slurry pumping system in accordance with the principles of the present invention.

2=final would be a likely method. Alternatively, a rapid change of incoming specific gravity, sump level (special additions), or other such adjustments could be used. Accordingly, as indicated in FIG. 9, the slurry pumping system can be controlled by first determining the instantaneous output pressure of the slurry adjacent the pump; determining the instantaneous pressure of the slurry remote from the pump; comparing the determined instantaneous slurry pressures; and varying the performance of the pump to equalize these pressures so that unstable operation is avoided.

The invention provides a method of comparing the pump instantaneous internal pressure of specific gravity with the system pressure to control slurry pump operation in a slurry pipeline. The instantaneous driving force or pressure that is controlled and destabilized by the incoming change in slurry specific gravity solids size, etc., in relation to the system can be determined and then used in relation to the overall system head to reduce or eliminate instability in operation. For instance, the measured input power of a pump along with its known performance can be used to calculate an instantaneous pump pressure and internal density that, when compared with an overall system resistance calculated from the elevations, flow, specific gravity, and the friction head component can be used to adjust the pump performance to minimize or eliminate unstable operation.

By the use of this technique or method operation in a so called unstable region, more steady and even operation will be possible. This will benefit mining and other customers whose processes and systems require this. Furthermore, operation in an unstable region is possible with the instabilities, the damage, and increased wear to the pump that go along with this reduced or eliminated.

According to the present method, the effective instantaneous pressure produced by a slurry pump can be determined from the pump instantaneous input power, rpm, flow, and other parameters. Finally, the effective instantaneous mixture specific gravity inside a slurry pump can be determined from the pump instantaneous input power, rpm, flow and other parameters. The effective internal pressure of an operating slurry pump can be used to control or stabilize operation of that pump or pumps in a pipeline system.

What is claimed is:

1. A method for controlling the operation of a slurry pumping system that includes a slurry pump, a motor in driving relationship with the pump, and a slurry pipeline system for receiving and directing the slurry pumped by the pump from a position in the pipeline adjacent the pump to a position in the pipeline remote from the pump, said method comprising:

determining the instantaneous output pressure of the slurry at the position adjacent the pump at a predetermined time;

determining the instantaneous pressure of the slurry in the pipeline at the remote position at the same predetermined time;

comparing the determined instantaneous pressures of the slurry at both positions in the pipeline; and varying the performance of the pump to keep the pressure of the slurry at the position adjacent the pump in substantially stable equilibrium with the pressure of the slurry at the remote position in the pipeline.

2. The method of claim 1, wherein the step of determining the instantaneous output pressure of the slurry at a position in the pipeline adjacent the pump at the predetermined time is accomplished by using the instantaneous driver power provided to the motor in accordance with:

$$P = \frac{Q \cdot H \cdot SG}{3960 \cdot \eta p}$$

where:

P=pump input power in horsepower,

Q=Usgpm units of slurry flow,

H=head of pump across pump inlets in feet of slurry mixture,

SG=specific gravity of the mixture inside the pump, and

ηp=pump efficiency to determine the combined H·SG instantaneous pressure term produced by the pump.

3. The method of claim 2, wherein the value of P is determined by a short time instantaneous reading of the pump motor input power and calculated in accordance with:

$$P = \frac{\sqrt{3}\, EI\cos\phi\eta_m}{0.746}$$

where:

E=volts,

I=amps, cosΦ=motor power factor usually 0.8 for a three phase motor, $\eta_m$=motor and gear box efficiency.

4. The method of claim 2, wherein the initial values of H and ηp in the expression $$P = \frac{Q \cdot H \cdot SG}{3960 \cdot \eta p}$$

are obtained from the previously obtained water performance of the pump and later corrected for the effect of the known pump size, known solid size, known solids SG, and calculated SG by resubstitution of the SG value until the SG difference between the value used for the correction and the value determined from $$P = \frac{Q \cdot H \cdot SG}{3960 \cdot \eta p}$$

is less than 0.01.

5. The method of claim 1, wherein the step of varying the performance of the pump comprises varying the particle size of the slurry.

6. The method of claim 1, wherein the step of varying the performance of the pump comprises varying the level of the sump at the inlet of the pump.

7. The method of claim 1, wherein the step of varying the performance of the pump comprises varying the speed of the pump.

8. A method for controlling the operation slurry pumping system that includes a slurry pump, a motor in driving relationship with said pump, and a slurry pipeline system for receiving and directing the slurry pumped by the pump from a position in the pipeline adjacent the pump to a position in the pipeline remote from the pump, said method comprising:

determining the instantaneous output pressure of the slurry at the position adjacent the pump at a predetermined time to determine the combined H·SG instantaneous pressure term produced in the slurry by the pump using the instantaneous driver power provided to the motor in accordance with:

$$P = \frac{Q \cdot H \cdot SG}{3960 \cdot \eta p}$$

where:

P=pump input power in horsepower,

Q=Usgpm units of slurry flow,

H=head of pump across pump inlets in feet of slurry mixture,

SG=specific gravity of the mixture inside the pump, and

ηp=pump efficiency;

determining the instantaneous pressure of the slurry in the pipeline at the remote position at the same predetermined time;

comparing the instantaneous pressures of the slurry at both positions in the pipeline; and varying the performance of the pump to keep the pressure of the slurry in the pipeline adjacent the pump in substantially stable equilibrium with the pressure of the slurry in the pipeline remote from the pump, wherein the value of P is determined by a short time instantaneous reading of the pump motor input power and calculated in accordance with:

$$P = \frac{\sqrt{3}\, EI\cos\phi\eta_m}{0.746}$$

where:

E=volts,

I=amps, cosΦ=motor power factor usually 0.8 for a three phase motor, $\eta_m$=motor and gear box efficiency.

9. The method of claim 8, wherein the initial values of H and ηp in the expression $$P = \frac{Q \cdot H \cdot SG}{3960 \cdot \eta p}$$

are obtained from the previously obtained water performance of the pump and later corrected for the effect of the known pump size, known solid size, known solids SG, and calculated SG by resubstitution of the SG value until the SG difference between the value used for the correction and the value determined from $$P = \frac{Q \cdot H \cdot SG}{3960 \cdot \eta p}$$

is less than 0.01.

10. The method of claim 8, wherein the step of varying the performance of the pump comprises varying the particle size of the slurry.

11. The method of claim 8, wherein the step of varying the performance of the pump comprises varying the level of the sump at the inlet of the pump.

12. The method of claim 8, wherein the step of varying the performance of the pump comprises varying the speed of the pump.

* * * * *